US005421710A

United States Patent [19]

Yorita et al.

[11] Patent Number: 5,421,710

[45] Date of Patent: Jun. 6, 1995

[54] FUEL INJECTION APPARATUS

[75] Inventors: Hiroshi Yorita, Kariya; Toshihiko Igashira, Toyokama; Yasuyuki Sakakibara, Nishio; Kou Otsuka, Toyohashi; Shigeiku Enomoto, Aichi; Moriyasu Gotoh, Toyohashi, all of Japan

[73] Assignee: Nippon Soken Inc., Nishio, Japan

[21] Appl. No.: 130,505

[22] Filed: Oct. 1, 1993

[30] Foreign Application Priority Data

Oct. 8, 1992 [JP] Japan ..... 4-270168
Apr. 22, 1993 [JP] Japan ..... 5-096097

[51] Int. Cl.[6] ..... F04B 9/08; F02B 3/00
[52] U.S. Cl. ..... 417/385; 123/300
[58] Field of Search ..... 123/299, 300, 25 R, 123/575; 417/413 R, 385, 395, 472, 383

[56] References Cited

U.S. PATENT DOCUMENTS

| | | | |
|---|---|---|---|
| 2,856,857 | 10/1958 | Saalfrank | 417/385 |
| 3,476,145 | 11/1969 | Thompson | 417/385 |
| 3,671,150 | 6/1972 | Jackson | 417/385 |
| 3,749,097 | 7/1973 | Grow | 123/575 |
| 4,520,774 | 6/1985 | Sitter | 123/300 |
| 4,551,076 | 11/1985 | Dubois | 417/395 |
| 4,612,905 | 9/1986 | Dietrich | 123/300 |
| 4,693,227 | 9/1987 | Satou | 123/300 |
| 5,088,901 | 2/1992 | Brauer | 417/395 |
| 5,201,297 | 4/1993 | Eblen | 123/506 |
| 5,244,360 | 9/1993 | Leffbure | 417/383 |

FOREIGN PATENT DOCUMENTS

| | | | |
|---|---|---|---|
| 864365 | 4/1941 | France | 417/385 |
| 628349 | 8/1949 | United Kingdom | 417/383 |

*Primary Examiner*—Carl S. Miller
*Attorney, Agent, or Firm*—Cushman, Darby & Cushman

[57] ABSTRACT

A fuel injection apparatus which, when raising fuel of a low viscosity and a low lubricating ability such as gasoline or methanol to a high pressure by a fuel injection pump and injecting it into a combustion chamber of an internal combustion engine etc., prevents the lubricating oil for the fuel injection pump from being diluted by this fuel by pressurizing a separate working oil with a viscosity and lubricating ability higher than the fuel by the fuel injection pump and raising the pressure of the fuel by a diaphragm apparatus by the pressure of the high pressure working oil and thereby supplies the same to the fuel injector.

11 Claims, 10 Drawing Sheets

FUEL INJECTION APPARATUS

BACKGROUND OF THE INVENTION

1. Field of the Invention

The present invention relates to a fuel injection apparatus for mainly an internal combustion engine for injecting fuel of a low viscosity or lubricating ability such as gasoline or methanol at a high pressure of tens of atmospheres or more.

2. Description of the Related Art

When supplying fuel with a relatively high viscosity or lubricating ability such as gas oil to a diesel engine at a high pressure, the fuel itself becomes the lubricating oil of the fuel injection pump, so there is no need to supply any special lubricating oil to the fuel injection pump, but when injecting fuel of a relatively low viscosity or lubricating ability such as gasoline or methanol into cylinders of an internal combustion engine under high pressure, that fuel does not act to lubricate the sliding portions between the plunger of the fuel injection pump and the pump cylinder receiving the same, so it is necessary to supply a lubricating oil other than the fuel to the sliding portions.

In such a case, the problem arises that when the lubricated sliding surfaces of the fuel injection pump are exposed by the movement of the pluriger, the fuel dissolves into the lubricating oil film, so the entire amount of the lubricating oil ends up diluted by the fuel and deteriorated, the lubricating ability of the lubricating oil falls, and wear of the fuel injection pump is invited.

Further, in a fuel injection pump which raises relatively flow viscosity fuel such as gasoline or methanol to a high pressure, fuel easily leaks from the sliding portions of the plunger and pump cylinder, so there is the problem that it is relatively difficult to maintain a high precision of adjustment or distribution of the fuel by the fuel injection pump.

SUMMARY OF THE INVENTION

The present invention has as its first object the solution of the problem of dilution of the lubricating oil of the fuel injection pump due to low viscosity or lubricating ability fuel and has as its second object the reduction of the amount of leakage of the fuel injection pump to increase the precision of adjustment and distribution.

The present invention, as the means for solving the above problems, provides a fuel injection apparatus comprising a fuel injection pump which is constituted so that it does not directly pressurize fuel itself, but pressurizes another working oil with a viscosity and lubricating ability higher than the above-mentioned fuel, a diaphragm apparatus which is constituted so that its inside space is divided into a working oil chamber and a fuel chamber by a flexible diaphragm, the above-mentioned working oil chamber having the pressurized working oil discharged by the fuel injection pump guided to it and the above-mentioned fuel chamber having the above-mentioned fuel supplied to it from a fuel supply source through a check valve, the fuel being pressurized by the working oil in a state completely separated from the pressurized working oil by the diaphragm, and a fuel injector connected to the fuel chamber so as to receive the fuel pressurized by the working oil in the fuel chamber and inject the same.

When the fuel injection pump in the fuel injection apparatus of the present invention, for example, injects at a high pressure a fuel with a low viscosity and lubricating ability such as gasoline or methanol, it does not pressurize the fuel directly, but pressuries another separate working oil with a viscosity and lubricating ability higher than the fuel and supplies the pressurized working oil to the working oil chamber of the diaphragm apparatus. The working oil chamber of the diaphragm apparatus adjoins the fuel chamber with the interposition of a flexible diaphragm. Fuel is supplied to the fuel chamber from a fuel supply source through a check valve, so the pressure of the pressurized working oil is transmitted to the fuel and thereby the pressure of the fuel is raised. The fuel indirectly pressurized in this way is injected in the same way as when sent to a fuel injector and, pressurized directly by a fuel injection pump. At this time, the working oil pressurized in the fuel injection pump and the fuel receiving the pressure from the working oil in the diaphragm apparatus are separated by a diaphragm, so the fuel and the working oil do not come into direct contact and there is no fear of the fuel dissolving in the working oil to dilute the same. Therefore, it is possible to completely prevent the problem of the dissolution of fuel in the lubricating oil at the sliding surfaces of the fuel injection pump pressurizing low viscosity and lubricating ability fuel and thereby the dilution and deterioration of the oil to invite wear of the sliding surfaces. Further, since the sliding surfaces of the fuel injection pump pressurizing the working oil is sufficiently lubricated by the working oil and there is no leakage of the high viscosity working oil from the clearances of the sliding surfaces, it is possible to avoid a reduction of the precision of the adjustment and distribution of the fuel injection pump even with fuel with a low viscosity and lubricating ability.

Other objects and effects will become clearer from the following explanation of the embodiments.

BRIEF DESCRIPTION OF THE DRAWINGS

In the attached figures.

DESCRIPTION OF PREFERRED EMBODIMENTS

Figure 1:
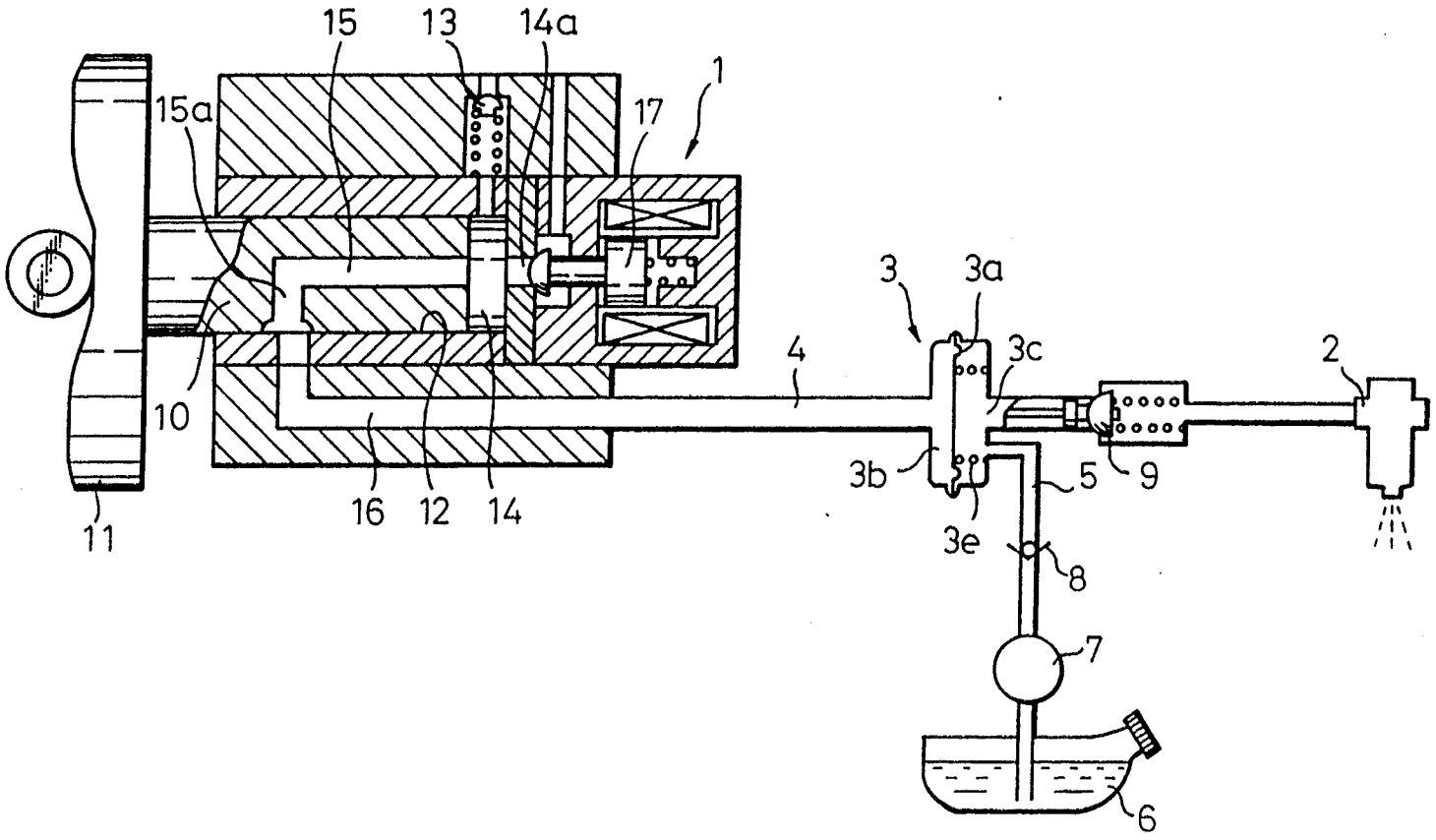
FIG. 1 is a cross-sectional view of the constitution of a basic embodiment of the present invention.

FIG. 1 shows a basic embodiment of the fuel injection apparatus of the present invention. Reference numeral 1 is a fuel injection pump having substantially the same constitution as the well known electronic control system distribution type fuel injection pump used in the past for diesel engines, but in the case of the present invention, it is applied to an internal combustion engine using fuel with a low viscosity or lubricating ability such as gasoline or methanol, so the fuel is not directly handled, but another working oil having a suitable viscosity and lubricating ability, such as lubricating oil, is handled, provision is not made of a delivery valve as a check valve directly in the fuel injection pump 1 itself, but the discharged high pressure working oil is supplied to a means for transmitting only the pressure in a state separate from the fuel, that is, a diaphragm apparatus, whereby the fuel is indirectly pressurized by the working oil in the diaphragm apparatus and the pressurized fuel is supplied to a fuel injector 2 provided in a cylinder of an internal combustion engine, not shown.

In the figure, 3 illustrates the diaphragm apparatus which separates the pressurized working oil handled by the fuel injection pump 1 and the fuel 5 supplied to the fuel injector 2 so that they do not come into direct contact and mix and simultaneously works to transmit as is to the fuel the pressure of the working oil raised to a high pressure by the fuel injection pump 1. One diaphragm apparatus 3 is provided for each cylinder of the engine, but in FIG. 1, only one is shown as a representative example. The inside space of each of the diaphragm apparatuses 3 is divided into a working oil chamber **3*b* and a fuel chamber 3*c* by a flexible thin-film diaphragm 3*a*. The diaphragm 3*a* may be biased in advance in one direction by a means such as for example a spring 3*e***.

A fuel 5 with a low viscosity and lubricating ability such as gasoline and methanol is stored in a fuel tank 6 and is taken up by a low pressure fuel pump 7 and pressurized to a relatively low feed pressure of less than several atmospheres and then supplied to the fuel chamber **3*c* of the diaphragm apparatus 3 through the check valve 8. Then, the fuel 5 given a high pressure of several tens of atmospheres by the working oil 4 through the diaphragm 3*a* is supplied to the fuel injector 2 through the delivery valve 9** and is injected into the cylinders of the engine to be burned therein.

As is well known, one distribution type fuel injection pump 1 is provided for several cylinders of the engine and has inside it a single plunger 10. As mentioned earlier, the fuel injection pump 1 in the present invention does not directly handle fuel, but handles a working oil 4 having a suitable viscosity and lubricating ability such as lubricating oil, but in the same way as the conventional distribution type fuel injection pump used in diesel engines, the plunger 10 is driven to rotate by the crankshaft of the engine and is made to reciprocate in the pump cylinder 12 by the action of a cam 11.

The reciprocal motion of the plunger 10 gives rise to an intake stroke in the left direction in the figure which takes in working oil from a working oil storage space such as a working oil tank, not shown, through an intake valve 13 into a pressurizing chamber 14 and a compression stroke in the right direction which pressurizes the working oil 4 taken into the pressurizing chamber 14 to a high pressure of for example several tens of atmospheres. Further, the continuous single-direction rotational motion of the plunger 10 acts to successively distribute and supply the working oil 4 raised to a high pressure in the pressurizing chamber 14 to the plurality of diaphragm apparatuses 3 provided corresponding to the cylinders of the engine.

More specifically, the oil supply passage 15 made in the center of the plunger 10 so as to communicate at all times to the pressurizing chamber 14 opens at part of the circumferential wall in one discharge port **15*a*. A plurality of openings made in the cylindrical wall of the pump cylinder 12 so as to successively register with the same communicate to the working oil chambers 3*b* of the plurality of diaphragm apparatuses 3 corresponding to the cylinders of the engine by respective oil supply passages 16**.

To control the timing of the start of the injection and the timing of the end of the injection and thereby control the amount of the fuel injection, a solenoid valve 17 is provided at a position able to open and close an opening **14*a* of the pressurizing chamber 14. When this is opened, the working oil 4 in the high pressure pressurizing chamber 14 can be returned to a not shown low pressure working oil storage space, so the pressure of the working oil in the pressurizing chamber 14 and the timing of its rise and fall can be freely controlled by opening or closing the solenoid valve 17** in the compression stroke by an external electronic control unit etc., not shown.

Next, an explanation will be made of the operation of the fuel injection apparatus of the embodiment shown in FIG. 1. By the reciprocal motion of the continuously rotating plunger 10 of the fuel injection pump 1 driven by the crankshaft of the internal combustion engine, the working oil 4 is pressurized to a high pressure of several tens of atmospheres, for example, in the pressurizing chamber 14, but since the working oil 4 has a high lubricating ability, the sliding surfaces of the plunger 10 and the cylinder 12 are fully lubricated by the working oil 4 and the friction and wear are reduced. Further, the working oil 4 has a suitable viscosity, so there is also no leakage from the minute clearances of the sliding surface.

When the discharge port **15*a* of the oil supply passage 15 formed in the plunger 10 communicates with the opening of an oil supply passage 16 communicating with any one of the working oil chambers 3*b* among the plurality of diaphragm apparatuses 3 provided in a number corresponding to the cylinders of the engine due to the rotation of the plunger 10, the plunger enters the compression stroke and the solenoid valve 17 closes, whereupon working oil 4 raised to a high pressure in the pressurizing chamber 14 raises the pressure of the working oil chamber 3*b* of the diaphragm apparatus 3 communicated with at that time to the same level, so the pressure is transmitted through the diaphragm 3*a* to the fuel 5 in the fuel chamber 3*c* and the pressure of the fuel 5 is raised to the same high level. As a result, the high pressure fuel 5 pushes open the delivery valve 9 and is injected from the fuel injector 2** to the inside of the engine cylinder where it is burned.

When the plunger 10 of the fuel injection pump 1 enters the intake stroke where it moves in the left direction in FIG. 1, the pressure of the working oil 4 in the pressurizing chamber 14, oil supply passage 15, oil supply passage 16, and working oil chamber **3*b* of the diaphragm apparatus 3 and the fuel in the fuel chamber 3*c* all fall, so the fuel 5 pressurized to several atmospheres from the pressure of the fuel tank 6 by the low pressure fuel pump 7 pushes open the check valve 8, fills the fuel chamber 3 of the diaphragm apparatus 3**, and waits for the next injection timing.

In this way, the fuel injection pump 1 of the embodiment of the present invention does not itself directly pressurize the fuel 5. The fuel 5 receives just the pressure from the pressurized working oil 4 through the diaphragm 3*a* of the diaphragm apparatus 3, whereby the fuel 5 is indirectly pressurized, as it were, by the fuel injection pump 1. Further, the fuel 5 pressurized in the diaphragm apparatus 3 is injected from the fuel injector 2 to the inside of the engine cylinder and burned there in exactly the same way as in the past where it was directly pressurized by the fuel injection pump 1, but in the embodiment of the present invention, since the fuel 5 is not directly pressurized by the fuel injection pump 1, there is no problem of dilution of the lubricating oil as mentioned earlier or problem of leakage of fuel in the fuel injection pump 1.

Figure 2:
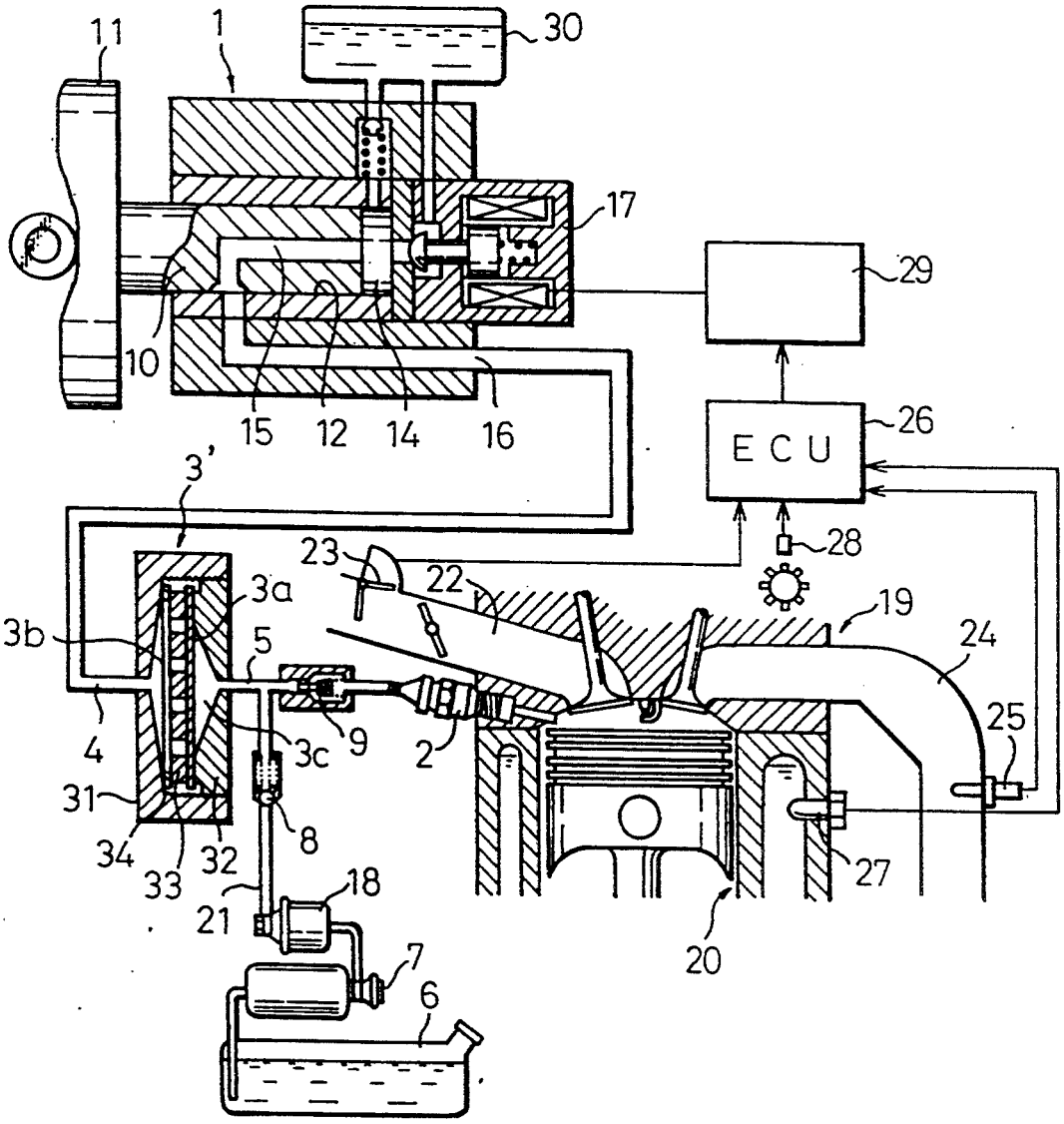
FIG. 2 is a cross-sectional view of the overall constitution of a specific embodiment of the present invention.

Next, FIG. 2 shows the overall constitution of a more specific embodiment regarding the case of application of the present invention to a high pressure gasoline injection apparatus of an automobile gasoline engine. In this embodiment too, the same reference numerals are given to portions substantially the same as in the above basic embodiment shown in FIG. 1 and overlapping explanations are omitted.

The housing of the diaphragm apparatus 3' shown in FIG. 2 is constructed with a disk-shaped lid 32 screwed into a cup-shaped container 31. In the shallow conically shaped depression formed at the mutually facing surfaces of the container 31 and the lid 32 are supported a diaphragm 3*a*, a multi-hole disk 33 supporting the same at the working oil chamber 3*b* side, and a copper ring shaped gasket 34 by clamping of the circumferential edges in a state superposed on each other in series. As the thin film diaphragm 3*a* in this case, for example, use may be made of a disk-shaped stainless steel plate of a diameter of 30 mm and a thickness of 50 μm or so. Note that the delivery valve 9 connected to the fuel chamber 3*c* of the diaphragm apparatus 3' is a check valve which opens only in the direction of the fuel injector 2.

As the fuel injector 2, for example, use may be made of a fuel injector well known in diesel engines and opening automatically by a fuel pressure of several tens of atmospheres (several Megapascals). In FIG. 2, 18 shows a fuel filter. The fuel tank 6, the low pressure fuel pump 7, and the fuel filter 18 can be used in common for a plurality of cylinders 20 (only one shown in FIG. 2) of the internal combustion engine 19, so a single fuel filter 18 and a plurality of check valves 8 provided for the cylinders 20 are actually connected by a branched fuel passage 21.

In the internal combustion engine shown in FIG. 2, like with a normal gasoline engine, an air flow meter 23 is provided in the middle of the intake passage 22 and an oxygen sensor 25 is provided in the middle of the exhaust passage 24. The signals issued by these are input to an electronic control unit 26. Further, the output signals of a water temperature sensor 27 for detecting the cooling water temperature of the internal combustion engine 19 and a rotational angle sensor 28 for detecting the rotational angle of the crankshaft of the internal combustion engine 19 are input to the electronic control unit 26 as well. The electronic control unit 26 detects various kinds of data showing the operating state of the internal combustion engine 19 by these sensors and performs computations on them to control the opening and closing of the solenoid valve 17 through a solenoid drive circuit 29. Note that 30 shows a working oil tank supplying working oil 4 to the fuel injection pump 1.

The operation of the embodiment of the fuel injection apparatus shown in FIG. 2 is basically the same as that explained with reference to the embodiment shown in FIG. 1, but there are more specific points such as the provision of the diaphragm apparatus 3' with a multi-hole disk 33, so some additional explanation will be added.

In the intake stroke of the fuel injection pump 1, when the plunger 10 moves to the left in the figure, the pressure of the working oil 4 in the working oil chamber 3*b* of the diaphragm apparatus 3' falls to about the atmospheric pressure. In this state, the discharge pressure of the low pressure fuel pump 7, that is, a fuel pressure of less than several atmospheres, works in the fuel chamber 3*c* of the diaphragm apparatus 3'. Therefore, the diaphragm 3*a* is pushed to the left side in the figure and stopped when coming into close contact with the surface of the diaphragm stopper, that is, the multi-hole plate 33, whereupon the fuel chamber 3*c* is filled with the fuel 5.

In the compression stroke of the fuel injection pump 1, when the plunger 10 moves to the right in FIG. 2, if the solenoid valve 17 is closed by the command of the electronic control unit 26, the diaphragm 3*a* of the diaphragm apparatus 3' is pushed to the right side by the working oil 4 discharged from the fuel injection pump 1. The fuel 5 in the fuel chamber 3*c* is pressurized and is delivered to the fuel injector 2 through the delivery valve 9. The diaphragm 3*a* displaces from the position of close contact with the multi-hole disk 33, so the amount of injection of the fuel injected from the fuel injector 2 corresponds to the amount of displacement of the diaphragm 3*a* from the above position and therefore the amount of discharge of the working oil 4 from the fuel injection pump 1.

Figures 3A, 3B, 3C, 3D:
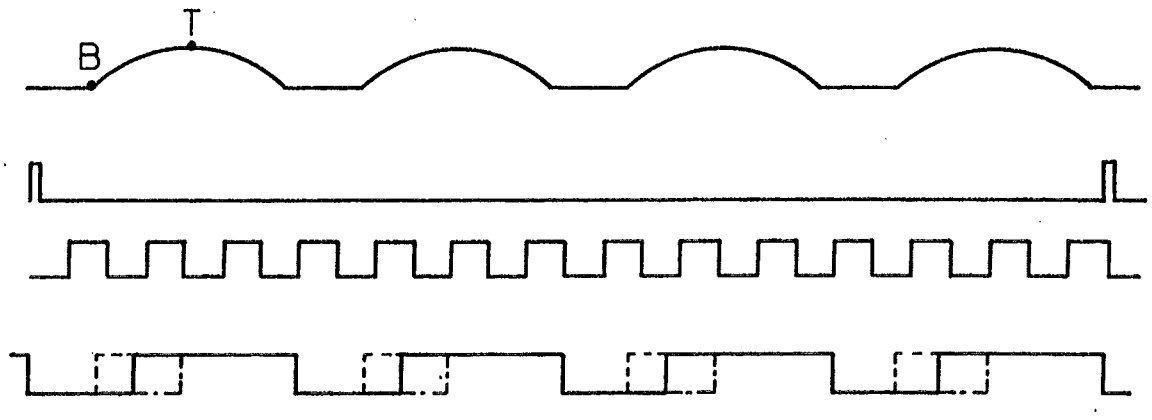
FIGS. 3(*a*)–3(*d*)=a time chart illustrating the operation of the embodiment of FIG. 2.

The electronic control unit 26 calculates the timing of opening and closing of the solenoid valve 17 based on the signals of the air flow meter 23 and the rotational angle sensor 28 so that the actual air-fuel ratio becomes close to the stoichiometric air-fuel ratio, sends a control signal to the solenoid drive circuit 29, and opens or closes the solenoid valve 17. FIG. 3 illustrates this timing. In FIG. 3, (a) shows a plunger lift, (b) a reference position signal, (c) a rotational angle signal, and (d) an opening or closing of the solenoid valve. The range of variation of the opening timing of the solenoid valve 17, in the illustrated case, is the period from the point B in the graph of the plunger lift of (a) of FIG. 3, that is, the time when the plunger 10 of the fuel injection pump 1 starts to lift, to the point T, that is, the time when the plunger 10 is at the top dead center. In actuality, in the timing chart of the opening and closing of the solenoid valve 17 shown in (d) of FIG. 3, it is the period from the time when the broken line starts to rise to the time when the dot-chain line begins to rise. Note that the range of variation of the closing timing of the solenoid valve 17 is limited to the period when the plunger 10 shown in (a) of FIG. 3 is at the bottom dead center.

The timing of the opening and closing of the solenoid valve 17 is determined by counting the number of pulses of the rotational angle signal shown in (c) of FIG. 3 issued by the rotational angle sensor 28 from the time when the pulse of the reference position signal shown in (b) of FIG. 3 (the sensor for detecting the reference position is not shown in FIG. 2) is issued. If the timing of opening of the solenoid valve 17 is made earlier as shown by the broken line in (d) of FIG. 3, the pressurizing and delivery period of the working oil 4 by the plunger 10 of the fuel injection pump 1 becomes shorter, so the amount of discharge of working oil by the fuel injection pump 1 falls and the amount of displacement of the diaphragm 3*a* of the diaphragm apparatus 3' and the amount of fuel injection fall. Conversely, if the opening timing of the solenoid valve 17 is made later as shown by the dot-chain line of (d) of FIG. 3, the amount of displacement of the diaphragm 3*a* becomes larger and the amount of fuel injection increases.

Further, if the temperature of the oxygen sensor 25 shown in FIG. 2 sufficiently rises and an air-fuel ratio signal is obtained (this state is detected by the signal of the water temperature sensor 27), the unit operates to make the opening timing of the solenoid valve 17 earlier when the air-fuel ratio is rich and operates to make the opening timing later when the air-fuel ratio is lean, thereby correcting the amount of fuel injection.

In this way, in the embodiment of FIG. 2 as well, by handling working oil 4 having a suitable viscosity and lubricating ability by the fuel injection pump 1, even in high pressure injection of fuel with a low viscosity and lubricating ability, such as gasoline and methanol, the adjustment and distribution of the amount of fuel injection are smoothly performed and there is no impairment of the precision of the injection and the durability of the fuel injection pump.

Figure 4:
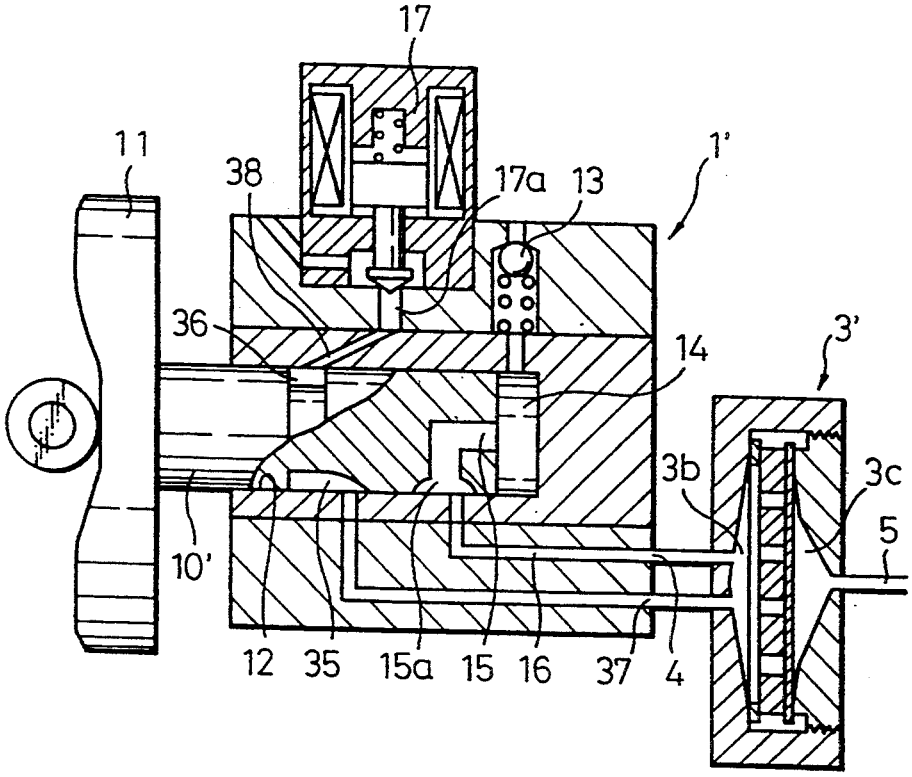
FIG. 4 is a cross-sectional view of the constitution of the key parts of another embodiment of the present invention.

FIG. 4 shows key portions of another embodiment. In this case too, the same reference numerals are given to portions substantially the same as the embodiment shown in FIG. 1 and FIG. 2 and overlapping explanations are omitted. The fuel injection pump 1' in this embodiment, in the same way as in the previous embodiment, is provided with an oil supply passage 15 passing through the center of the plunger 10' and a discharge port 15*a* opening to a specific position in the outer circumference of the plunger 10' and, further, is provided with a spill port 35 opening to another specific position and an annular groove 36 communicating with the same.

The diaphragm apparatus 3', provided in a number corresponding to the cylinders of the internal combustion engine, has substantially the same structure as the diaphragm apparatus 3' shown in FIG. 2, but in addition to the oil supply passage 16, the spill passage 37 also communicates with the working oil chamber 3*b*. The other end of the spill passage 37 opens to the inside wall of the cylinder 12. Further, when the discharge port 15*a* communicates with the oil supply passage 16 at a specific position of the plunger 10', the spill port 35 simultaneously communicates with the spill passage 37. The passage and port are positioned in this way. The annular groove 36 comunicates to the inlet 17*a* of the solenoid valve 17 at all times by another spill passage 38. The construction of the solenoid valve 17 may be the same as mentioned earlier.

In the compression stroke of a distribution type fuel injection pump 1', when the plunger 10' arrives at the position of FIG. 4, like with the embodiment shown in FIG. 2, the working oil 4 raised to a high pressure of over several tens of atmospheres in the pressurizing chamber 14 passes through the oil supply passage 15, the discharge port 15*a*, and the oil supply passage 16 to be sent into the working oil chamber 3*b* of the diaphragm apparatus 3'. By this, the fuel in the fuel chamber 3*c* is raised to a high pressure and fuel injection from the fuel injector, not shown, to the inside of the engine cylinder is started.

In the fuel injection apparatus of the embodiment of FIG. 4, when a single fuel injection ends, the solenoid valve 17 opens. By this, the pressurized working oil 4 in the working oil chamber 3*c* of the diaphragm apparatus 3' passes through the spill passage 37, the spill port 35, the annular groove 36, the spill passage 38, and the solenoid valve 17 to return to the working oil tank, not shown. The fuel chamber 3*c* of the diaphragm apparatus 3' becomes low in pressure, so the fuel for the next operaion is taken into the fuel chamber 3*c* to fill the same. If the working oil 4 is circulated in this way, it is possible to prevent deterioration of the working oil 4 and to maintain a continuous trouble-free operation over a long period of time.

Figure 5:
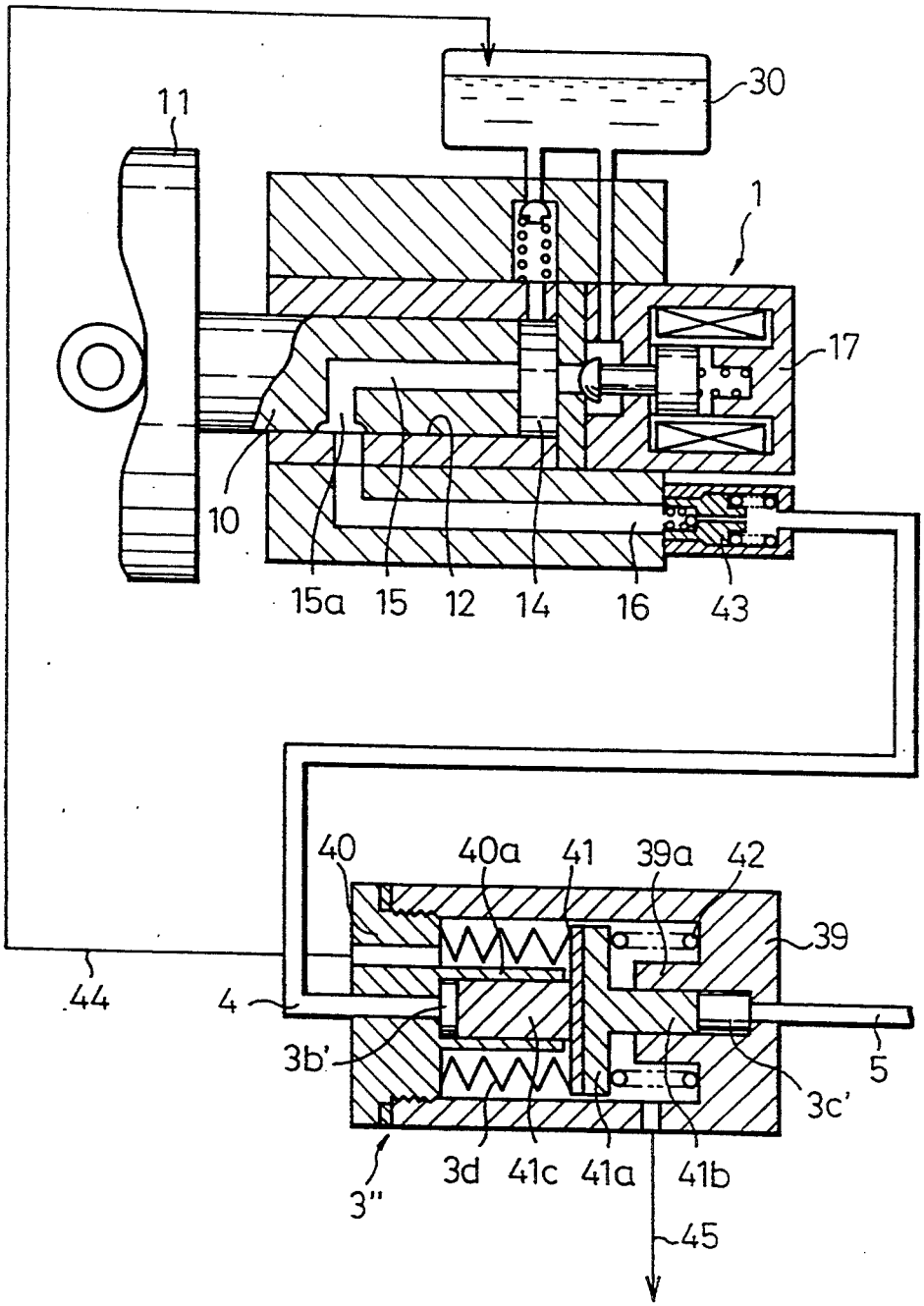
FIG. 5 is a cross-sectional view of the constitution of still another embodiment of the present invention.

Another embodiment is shown in FIG. 5. For the diaphragm apparatus 3 or 3' in the above embodiments, use was made of a thin plate like diaphragm 3*a* for completely separating the working oil 4 and the fuel 5 and transmit the pressure between the same, but in the diaphragm apparatus 3'' in this embodiment, instead of the plate-like diaphragm, use is made of both a bellows-shaped diaphragm for separating the working oil and the fuel and a piston-cylinder mechanism for transmitting the pressure between the two.

A cylindrically shaped container 39 with a bottom and a screw lid 40 screwed in its opening constitute the housing of the diaphragm apparatus 3''. Inside, there are accommodated a bellows-shaped diaphragm 3*d*, a twin-head piston 41 having a flange, and a compression spring 42 interposed between a plunger 41*a* and the bottom of the container 39. The two ends of the bellows-shaped diaphragm 3*d* are attached to the plunger 41*a* and the screw lid 40 to maintain an air-tight state. The twin-head piston 41 is provided so as to project out the piston 41*b* and the piston 4*c* on the same axis in the opposite directions. One of the pistons, 41*c*, slidingly fits into the cylinder 40 formed in the screw lid 40 to form a working oil chamber 3*b'*. The other piston 41*b* slidingly fits into the cylinder 39*a* formed at the bottom of the cylindrically shaped container 39 to form the fuel chamber 3*c'*. The "piston-cylinder mechanism" is formed in this way.

While not shown, the fuel chamber 3*c'* communicates with the fuel injector of the engine through a delivery valve for discharging high pressure fuel in the same way as the fuel chamber 3*c* of the embodiment shown in FIG. 1 and FIG. 2. Also, it communicates with the low pressure fuel pump through the check valve for receiving the low pressure fuel. The working oil chamber 3*b'*, in the same way as in the above embodiments, is connected to the fuel injection pump 1 through the oil supply passage 16 so as to receive the pressurized working oil 4, but it is also possible to interpose a "constant residual pressure valve" in the middle of the oil supply passage 16. The illustrated constant residual pressure valve 43 is an assembly of two check valves able to open in opposite directions, so by suitably setting the valve opening pressure in the return direction, in particular, a residual pressure of a predetermined magnitude is produced in the working oil chamber 3*b'* even if the pressurizing chamber 14 is low in pressure when the plunger 10 is in the intake stroke.

If there is a leakage in the piston-cylinder mechanism, the working oil 4 leaks out to the inside space of the bellows-shaped diaphragm 3*d* from the working oil chamber 3*b'*, but the leaked working oil 4 can be returned to the working oil tank 30 through a drain passage 44. Further, the fuel 5 leaks out to the external space of the bellows-shaped diaphragm 3*d* from the fuel chamber 3*c'*, but the leaked fuel 5 can be returned to the fuel tank, not shown, through a drain passage 45. Therefore, even if the working oil 4 and the fuel 5 leak out from the piston-cylinder mechanism, they are completely separated by the diaphragm 3*d* and there is no dilution of the working oil 4 by the dissolution of fuel 5 in the working oil 4.

Since the embodiment shown in FIG. 5 has the abovementioned structure and the bellows-shaped diaphragm 3*d* of the diaphragm apparatus 3″ is strongly biased in the left direction in the figure by the compression spring 42, when the plunger 10 of the fuel injection pump 1 is in the intake stroke and the working oil chamber 3*b*′ becomes low in pressure and the fuel 5 is taken into the fuel chamber 3*c*′, even if the working oil 4 of the working oil chamber 3*b*′ rapidly falls in pressure, the diaphragm 3*d* can move faithfully following this without any delay.

Further, even in the case when a constant residual pressure valve 43 is provided in the oil supply passage 16, the diaphragm 3*d* can move fully to the left in the range of movement and perform the same operation as in the above embodiments. In this case, further, it is possible to prevent so-called "irregular discharge" accompanying abnormal pulsation of the fuel injection pump 1, for example, by the action of the constant residual pressure valve 43. Note that in the embodiment of FIG. 5, dilution of the working oil 4 by the fuel 5 is completely prevented by the separation effect of the diaphragm 3*d*, but in this embodiment the assumption is that there is leakage in the piston-cylinder mechanism, so it is not possible to expect an improvement in the precision of adjustment due to the leakage of the fuel 5.

In the above explanation, gasoline and methanol were mentioned as the fuel 5 used, but the present invention can of course also be applied to the case of use of other liquid fuels having a relatively low viscosity and lubricating ability such as gas oil. Further, as the fuel injector 2 illustration and explanation was made in the embodiments of the case of injection of fuel in the cylinder of an internal combustion engine, but when working the present invention, it is also possible to provide the fuel injection valve 2 at the upstream side of the combustion chamber of the cylinder, for example, at the intake manifold of the engine.

Figure 6:
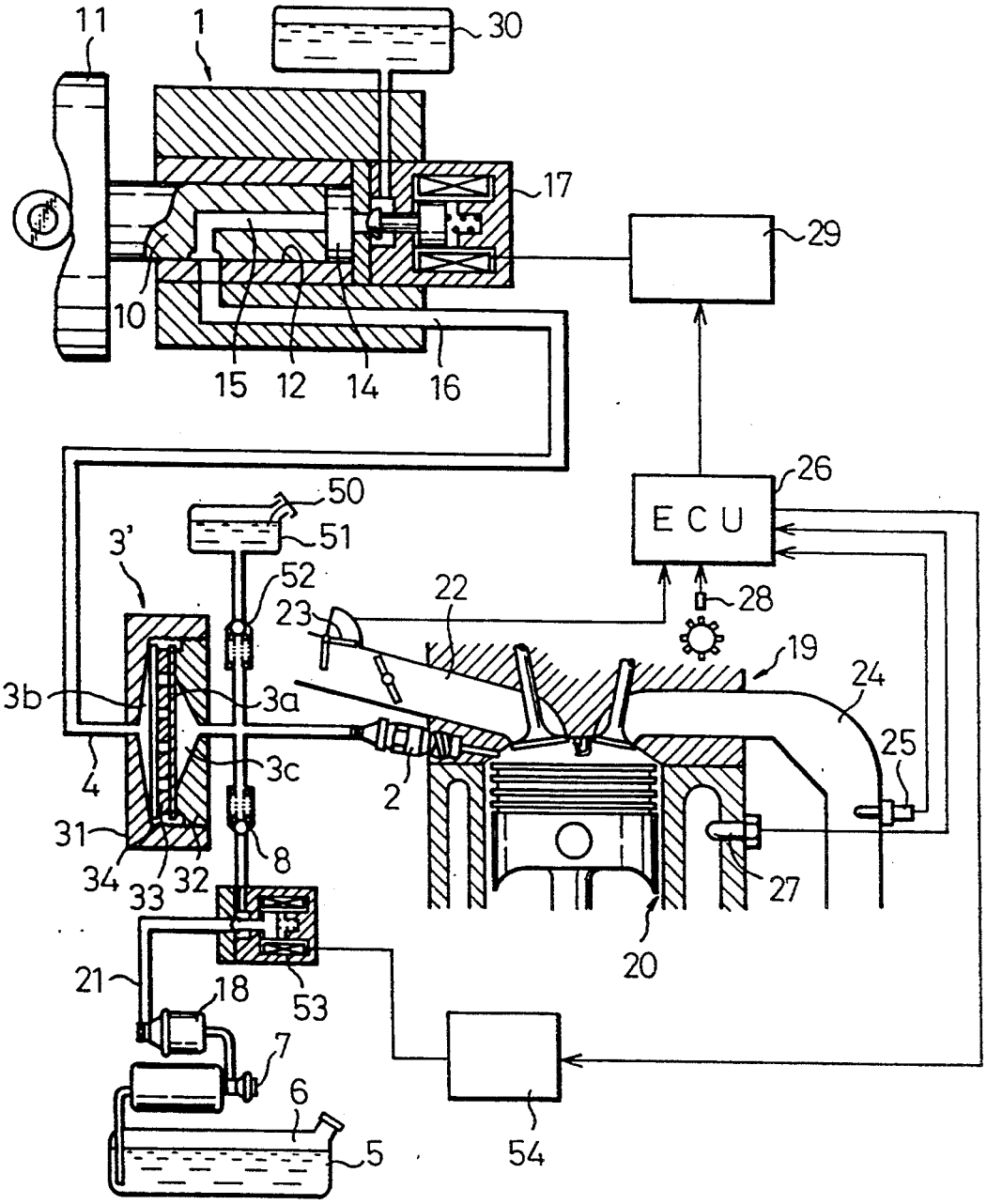
FIG. 6 is a cross-sectional view showing still another embodiment of the present invention.

Next, the constitution of the embodiment in the case of application of the present invention to an internal combustion engine wherein another fluid such as water is supplied along with fuel is shown in FIG. 6.

As one method for reducing the amount of NOx included in the exhaust gas of an internal combustion engine, it is generally known to be effective to add water to the fuel supplied. In this case, however, to prevent the occurrence of rust in the fuel system with water in it, it becomes necessary to use a rust resistant material such as stainless steel. Such a material, however, is usually generally nonmagnetic. Fabrication of the solenoid valves and pumps etc. used in the fuel system by nonmagnetic materials is difficult, so it is not possible to simply control the amount of the water added.

The embodiment shown in FIG. 6 relates to an internal combustion engine using a fuel supply system which indirectly pressurizes fuel to a high pressure by a working oil, such as the high pressure gasoline injection apparatus of an automobile gasoline engine shown in FIG. 2. When water is added as the fluid separate from the fuel, use is made of a diaphragm and a check valve to divide the portion of the fuel injection control system into the portion with water mixed in and the portion with no water mixed in. The portion with no water mixed in is provided with equipment like an ordinary pump and solenoid valve which might rust and controls the amount of fuel injection and the amount of water added. The portion with the water mixed in alone is provided with measures to prevent the occurrence of rusting. By this, it is possible to simply construct the fuel injection control system at a low cost and with rust prevention measures and sufficient control functions.

The differences in construction of the embodiment shown in FIG. 6 from that shown in FIG. 2 are, first, that a water tank 51 containing water 50 is connected to the fuel chamber 3*c* of the diaphragm apparatus 3′ through a check valve 52, a mix control valve 53 for controlling the ratio of addition of the water 50 in the fuel 5 is inserted in the middle of the fuel passage 21 connecting the fuel filter 18 and the check valve 8 and is controlled to open and close by a control valve drive circuit operating receiving control signals of the electronic control unit 26, and just the portions of a relatively simple construction, such as the diaphragm 3*a* of the diaphragm apparatus 3′, the water tank 51, the check valve 52, the check valve 8, the fuel injector 2, and the piping connecting the same, are made a rust-proof construction using stainless steel, while other portions, in particular the low pressure fuel pump 7, the solenoid valve 17, the mix control valve 53, and other portions where stainless steel is hard to use, are made using ordinary parts able to be cheaply obtained.

Figures 7A, 7B, 7C, 7D, 7E:
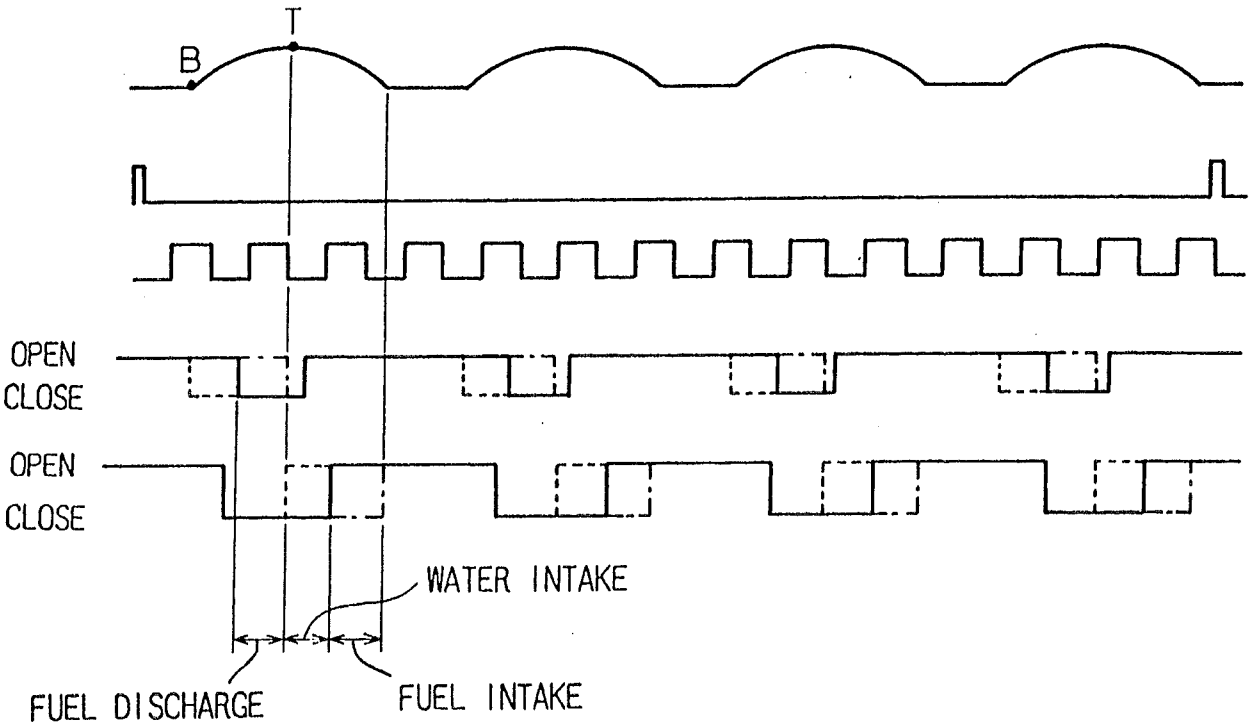
FIGS. 7(*a*)–7(*e*)=a time chart illustrating the operation of the embodiment of FIG. 6.

FIG. 7 is a time chart showing the operation of the fuel supply system of the internal combustion engine shown in FIG. 6. Like in FIG. 3, (a) shows a plunger lift, (b) a reference position signal, (c) a rotational angle signal, and (d) an opening or closing of the solenoid valve, while (e) shows the opening and closing of the mix control valve. In the compression stroke of the plunger 10 when the solenoid valve 17 attached to the fuel injection pump 1 is closed, fuel (in this case, containing water) is injected from the fuel injector 2 in the same way as the operation of the system of FIG. 2 shown in FIG. 3. When the plunger 10 enters the intake stroke, the pressure of the working oil chamber 3*b* of the diaphragm apparatus 3′ falls and the plunger 3*a* moves to the left in FIG. 6 due to its own elasticity. At this time, if the mix control valve 53 closes, the fuel chamber 3*c* become negative in pressure, the check valve 52 opens, and the water 50 is taken into the fuel chamber 3*c*. If the mix control valve 53 opens during the intake stroke of the plunger 10, the fuel 5 pushes open the check valve 8 due to the feed pressure of the low pressure fuel pump 7 and flows into the fuel chamber 3*c*. As a result, the pressure in the fuel chamber 3*c* is raised, so the check valve 52 closes and the supply of the water 50 to the inside of the fuel chamber 3*c* is stopped. In this way, if the timing at which the mix control valve 52 is made earlier, the amount of mixture of the water 50 falls, while if the timing of opening is made later, the amount of mixture increases. It becomes possible to control the amount of mixture of the water 50 by just the opening/closing control of a single mix control valve 53.

In this case, it should be noted that the key portions like the low pressure fuel pump 7, the solenoid valve 17, and the mix control valve 53 which are relatively complicated in structure and are difficult to fabricated by rust-free nonmagnetic materials such as stainless steel are completely free from contact with the water 50 and only come into contact with fuel which is not liable to cause rust in the parts. By this, it becomes possible to use relatively inexpensive ordinary parts even in these key portions and possible to fabricate the system of FIG. 6 easily at a low cost.

Figure 8:
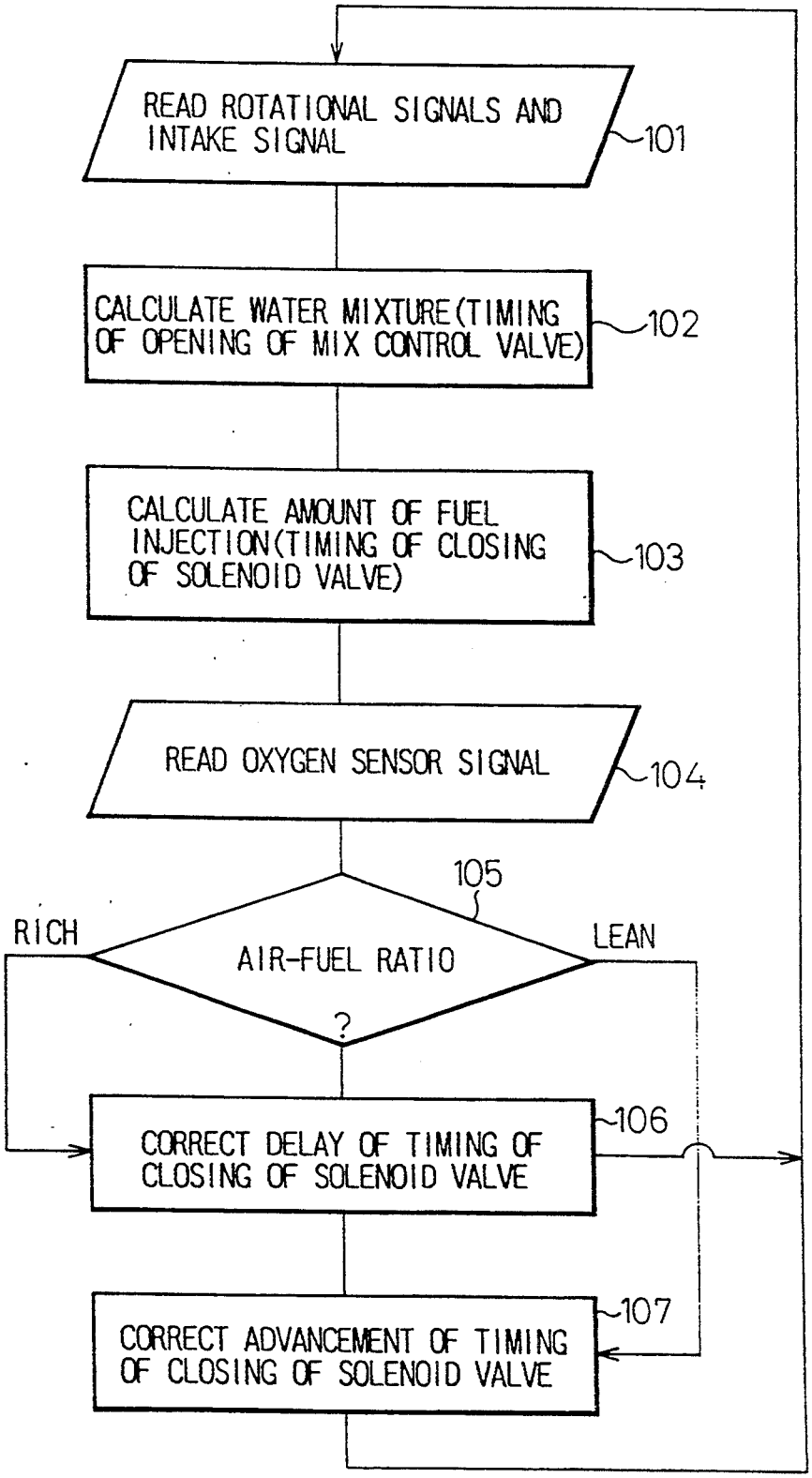
FIG. 8 is a flow chart illustrating the routine of control in the embodiment of FIG. 6.

The routine for determining the timing of opening and closing of the solenoid valve 17 and the mix control valve 53 by the electronic control unit 26 in the fuel and water supply system of the internal combustion engine shown in FIG. 6 is illustrated in the flow chart of FIG. 8. This program is executed repeatedly interspaced by short time periods by the electronic control unit 26 while the internal combustion engine is operating.

First, at step 101, the microprocessor built in the electronic control unit 26 reads the rotational signal such as the rotational angle signal and reference position signal issued by a rotational angle sensor 28 etc. and the intake signal issued by the air flow meter 23. At step 102, the electronic control unit 26 calculates the amount of mixture of water, that is, the timing of opening of the mix control valve 53, from map data based on the read signals. At step 103, it calculates the amount of fuel injection, that is, the timing of closing of the solenoid valve 17.

At step 104, further, it reads the signal output by the oxygen sensor 25. At step 105, it judges if the air-fuel ratio is rich or not rich (lean). If the air-fuel ratio is rich, the routine proceeds to step 106, where the timing of closing of the solenoid valve 17 is corrected to the delayed angle side by a predetermined amount (to delay the timing of closing), while when it is lean, the routine proceeds to step 107, where the timing of closing of the solenoid valve 17 is corrected to the advanced angle side by a predetermined amount (to speed up the timing of closing). After this, in both cases, the routine returns to step 101 where the same control routine is repeatedly executed.

Next, still another embodiment of the present invention will be explained using FIG. 9 and FIGS. 10(*a*-)–10(*e*). In the fuel injection apparatuses of the present invention of the above-mentioned embodiments shown in FIG. 2 etc., it was necessary that the following two requirements be met to enable accurate adjustment of the working oil 4 at each cycle and obtain a high precision of the amount of fuel injection:

(1) The diaphragm 3*a* had to be returned to the position of close contact with the multi-hole disk 33 (referred to here as "zero point return") at the timing of intake of the fuel 5 to be injected in the next cycle in the fuel chamber 3*c* of the diaphragm apparatus 3. Therefore, the pressure of the working oil chamber 3*b* had to be sufficiently lower than the pressure of the fuel chamber 3*c* at the timing of intake of fuel 5 in the fuel chamber 3*c*.

(2) Just before the start of the compression stroke of the plunger 10 at each cycle, the pressure of the working oil 4 in the pressurizing chamber 3*b*, the oil supply passage 16, and the working oil chamber 3*b* must be a certain value.

To meet the above two requirements and ensure a high precision of the amount of fuel injection, in this embodiment, at the timing of intake of fuel 5 in the fuel chamber 3*c*, the working oil chamber 3*b* of the diaphragm apparatus 3 is not only communicated with a low pressure chamber 55 storing the working oil 4 (even though the term "low pressure" is used, it is pressurized to several atmospheres or so by a feed pump, not shown) to reduce the pressure of the working oil chamber 3*b* to several atmospheres or so, but also, before that, the working oil chamber 3*b* is lowered in pressure to the atmospheric pressure or so, which is even lower than the low pressure chamber 55 to cause as large a pressure difference as possible between the fuel chamber 3*c* and the working oil chamber 3*b*. By this, the diaphragm 3*a* is made to reliably return to the zero point and the fuel in the fuel chamber 3*c* of the diaphragm apparatus 3 can be accurately adjusted. Also, before the plunger 10' enters the compression stroke, the pressurizing chamber 14, the oil supply passage 16, and the working oil chamber 3*b* are communicated with the low pressure chamber 55 so that they hold working oil 4 of a certain pressure of several atmospheres or so at all times at the timing of the start of each cycle.

Specifically, it is possible to use a low pressure chamber of a timer mechanism, not shown, provided at the fuel injection pump 1 as a low pressure source of a pressure lower than the pressure of the low pressure chamber 55. The construction of the timer mechanism itself is known as part of a conventional fuel injection pump and needs no explanation here. The low pressure chamber of the timer mechanism is constantly at a certain low pressure of about the atmospheric pressure. In the embodiments of the present invention, the fuel 5 is not directly pressurized, but is indirectly pressurized by the working oil 4, but for automatic adjustment of the fuel injection timing, it is possible to provide a time mechanism of the same construction for handling the working oil 4 in the same way as the fuel in a conventional distribution type fuel injection pump, so it is possible to use the low pressure chamber as a low pressure source. The passage 57 shown schematically in FIG. 9 is a piping connecting to the low pressure chamber of the timer mechanism, not shown.

Figure 9:
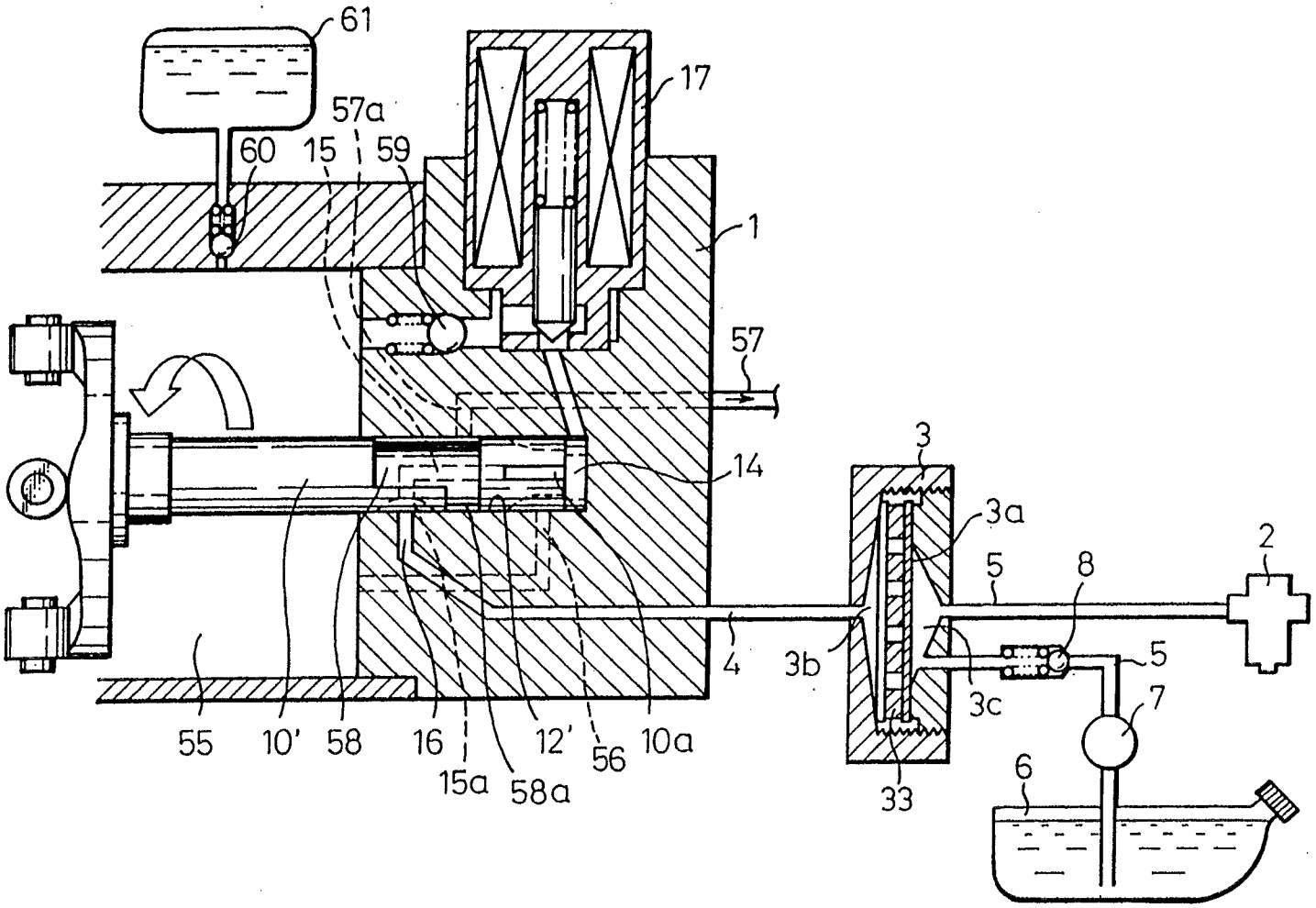
FIG. 9 is a cross-sectional view of the constitution of still another embodiment of the present invention.
Figures 10A, 10B, 10C, 10D, 10E:
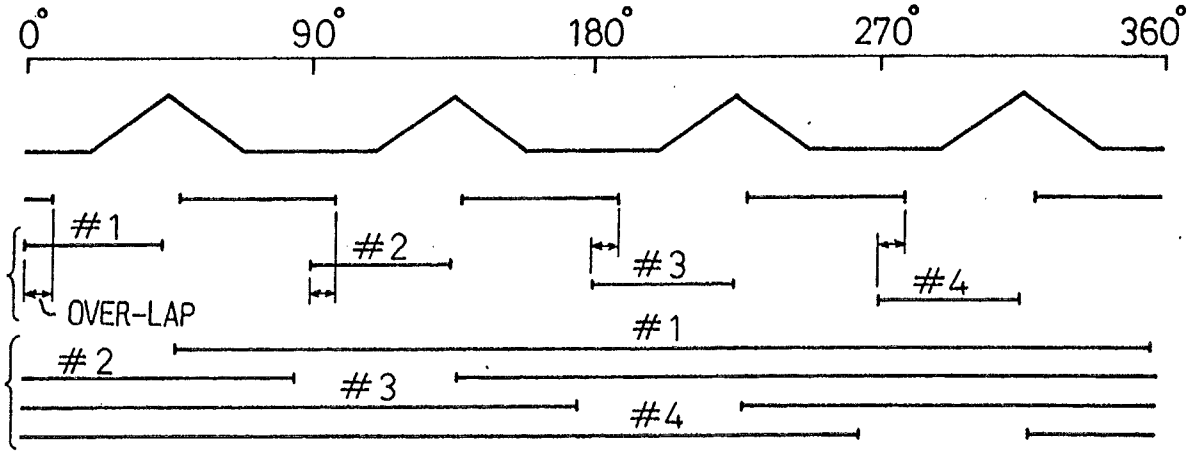
FIGS. 10(*a*)–10(*e*)=a time chart illustrating the operation of the embodiment of FIG. 9.

In the embodiment shown in FIG. 9, the characteristic features lie in the shape of the port provided in the plunger 10' and the construction of the opening provided in the cylinder 12' receiving the plunger 10'. First, in the plunger 10', a number of intake grooves 10*a* corresponding to the number of cylinders of the engine are formed in the axial direction on the outer circumferential surface of the front end. The intake grooves 10*a* themselves are provided in the conventional distribution fuel injection pump also, so require no particular detailed explanation here. However, in this embodiment, the fluid passing through the intake grooves 10*a* is not fuel 5, but the working oil 4. The number of intake grooves 10*a* are constantly communicated with the pressurizing chamber 14. At a predetermined rotational position of the intake stroke where the plunger 10' heads in the left direction in the figure, one end opens to the cylinder 12', while the other end registers with the intake hole 56 opening to the low pressure chamber 55. By this, the low pressure chamber 14 communicates with the low pressure chamber 55 and the working oil 4 in the low pressure chamber 55 can be taken in the pressurizing chamber 14.

The plunger 10', in the same way as in the above-mentioned embodiments, is provided with an oil supply passage 15 in its center and a single discharge port 15*a* by which it opens toward the surface of the cylinder 12'. One of the characteristic features of the embodiment, however, is that a depression known as the equalizing port 58 is formed at a portion of the surface of the plunger 10' occupying a considerably large region not only in the axial direction, but also in the rotational direction. This equalizing port 58 is in constant communication with the opening 57*a* of the passage 57 communicating to the low pressure chamber of the timer mechanism no matter what axial direction and rotational direction position the plunger 10' is in. Therefore, the equalizing port 58 is provided with a portion of an annular groove 58*a* extending over the entire circumference of the plunger 10'. Further, depending on the rotational position of the plunger 10', the equalizing port 58 can communicate with the opening of the oil supply passage 16 provided at the cylinder 12' side. By this, the oil supply passage 16 and the working oil chamber 3*b* of the diaphragm apparatus 3 connected to it are connected to the low pressure chamber of the timer mechanism through the passage 57 and the pressures can be made atmospheric pressure. The period in which the oil supply passage 16 and the working oil chamber 3*b* become equal to the atmospheric pressure is referred to as the "equalizing port communication period" or the "equalizing period". This equalizing period is determined by the position of the plunger 10'.

Another feature of the embodiment of FIG. 9 is that an overlap period of a predetermined length before the compression stroke of the plunger 10' is set between the period during which the intake groove 10*a* provided on the surface of the plunger 10' communicates with the intake hole 56 provided in the cylinder 12' and the period during which the discharge port 15*a* of the oil supply passage 15 provided in the plunger 10' communicate with the oil supply passage 16 provided in the cylinder 12'. The rest of the structure is the same as in the above-mentioned embodiments, so the same reference numerals are attached and explanations thereof are omitted.

Note that in the embodiment of FIG. 9, the constitution of making the solenoid valve 17 releasing the high pressure of the pressurizing chamber 14 at the end of the fuel injection period communicate with the low pressure chamber 55 through the check valve 59 and the constitution of making the low pressure chamber 55 communicate with the working oil tank 61, which is a substantially atmospheric pressure, through the check valve 60 opening at a predetermined pressure of several atmospheres or more and maintaining the pressure in the low pressure chamber 55 at a certain pressure of several atmospheres are not described in the explanations of the above embodiments, so these points can be said to be additional features of this example.

The operation of the fuel injection apparatus shown in FIG. 9 will now be explained with reference to the time chart illustrated in FIG. 10. In FIG. 10, (a) shows a pump rotational angle, (b) a plunger lift, (c) an intake groove communication period, (d) a discharge port communication period, and (e) an equalizing port communication period. The fact that, in the compression stroke where the plunger 10' moves in the right in FIG. 9, the fuel injector 2 injects fuel 5 in the period when the solenoid valve 17 is closed is the same as in the case of the above embodiments, but when the equalizing port 58 of the plunger 10' is communicated with the oil supply passage 16 of the cylinder side 12', the working oil 4 in the working oil chamber 3*b* flows through the oil supply passage 16, the equalizing port 58, and the passage 57 to the low pressure chamber of the timer mechanism, so the working oil chamber 3*b* becomes atmospheric pressure and enters the previously defined equalizing period. By the working oil chamber 3*b* becoming atmospheric pressure, which is lower than even the pressure of the low pressure chamber 55, the diaphragm 3*a* returns to the position of close contact with the multi-hole disk 33 quickly by the relatively large pressure difference between the atmospheric pressure of the working oil chamber 3*b* and the pressure of the fuel remaining in the fuel chamber 3*c*, the zero point return of the diaphragm 3*a* is achieved, and the above-mentioned requirement (1) is met.

In the next intake stroke of the plunger 10' for sending fuel 5 to the fuel injector 2 of another cylinder, the working oil 4 pressurized to several atmospheres is taken in from the low pressure chamber 55 through the intake hole 56 and the intake groove 10*a* to the pressurizing chamber 14. At this time, since an overlap period of the communication period is set, the pressure of the working oil chamber 3*b* of the diaphragm apparatus 3 and the oil supply passage 16 is raised to the pressure of the low pressure chamber 55 just before the plunger 10' enters the compression stroke, that is, to several atmospheres, and the compression stroke of the plunger 10' is awaited. In this way, since the working oil 4 of the working oil chamber 3*b* starts to be pressurized by the plunger 10' from the constantly same pressure of the low pressure chamber 55, the above-mentioned requirement of (2) is also satisfied. Together with the fulfilment of the requirement (1), that is, the diaphragm 3*a* of the diaphragm apparatus 3 returning reliably to the zero point at each cycle, the amount of adjustment of the fuel injection becomes accurate and it is possible to realize a high precision fuel injection by the fuel injection valve 2.

We claim:

1. A fuel injection apparatus for an engine comprising:

a working oil pressurizing means for pressurizing working oil with a viscosity and lubricating ability higher than fuel to be injected into the engine and provided with at least a plunger inserted in a pump cylinder and constituting a pressurizing chamber, and a cam causing the plunger to move reciprocally, a diaphragm apparatus having an inside space divided into a working oil chamber and a fuel chamber by a flexible diaphragm, the working oil chamber having the pressurized working oil ejected by the working oil pressurizing means guided thereto and the fuel chamber having the fuel supplied thereto from the fuel supply source through a check valve, the fuel being pressurized by the working oil in a state completely separated from the pressurized working oil by the diaphragm, and a fuel injector connected to the fuel chamber so as to receive the fuel pressurized by the working oil in the fuel chamber and inject the same into the engine, wherein, before the working oil pressurizing means pressurizes the working oil, the working oil chamber of the diaphragm apparatus is connected to a low pressure source of constant pressure such as atmospheric pressure by a passage formed in the pump cylinder and a passage formed in the plunger coming into register.

2. A fuel injection apparatus for an engine comprising:

a working oil pressurizing means for pressurizing working oil with a viscosity and lubricating ability higher than fuel to be injected into the engine and provided with at least a plunger inserted in a pump cylinder and constituting a pressurizing chamber and a cam rotationally driven by a power source causing the plunger to move reciprocally, a plurality of diaphragm apparatuses having their inside spaces respectively divided into a working oil chamber and a fuel chamber by a flexible diaphragm, the working oil chamber having the pressurized working oil effected by the working oil pressurizing means guided thereto and the fuel chamber having the fuel supplied thereto from the fuel supply source through a check valve, the fuel being pressurized by the working oil in a state completely separated from the pressurized working oil by the diaphragm, and a plurality of fuel injectors respectively connected to the fuel chambers of the diaphragm apparatuses so as to receive the fuel pressurized by the working oil in the fuel chambers and inject the fuel into the engine, wherein the rotational motion of the cam acts to successively distribute and supply the working oil raised to a high pressure in the pressurizing chamber of the working oil pressurizing means to the working oil chambers of the plurality of diaphragm apparatuses and then to successively connect the working oil chambers to a low pressure source of a constant pressure such as atmospheric pressure.

3. A fuel injection apparatus according to claim 1, wherein the diaphragm apparatus is provided with a flexible thin-film diaphragm and a multi-hole plate supporting one surface of the thin-film diaphragm.

4. A fuel injection apparatus according to claim 1, wherein the working oil pressurizing means is provided with a spill passage which can be opened and closed by its own plunger and which communicates with the working oil chamber of the diaphragm apparatus.

5. A fuel injection apparatus according to claim 1, wherein the diaphragm apparatus is provided with a flexible bellows-shaped diaphragm.

6. A fuel injection apparatus according to claim 1, wherein the diaphragm apparatus is biased in one direction by an elastic means.

7. A fuel injection apparatus according to claim 5, wherein the said flexible bellows-shaped diaphragm apparatus cooperates with a piston-cylinder mechanism for transmitting pressure formed between the working oil chamber and the fuel chamber.

8. A fuel injection apparatus according to claim 1, wherein the fuel chamber of the diaphragm apparatus is supplied with other fluid in parallel with the fuel through a check valve.

9. A fuel injection apparatus according to claim 8, wherein the other fluid is water.

10. A fuel injection apparatus according to claim 1, wherein the pressurizing chamber is provided with a valve means for reducing the pressure.

11. A fuel injection apparatus according to claim 10, wherein the valve means is a solenoid valve.

* * * * *